United States Patent [19]

Baatz et al.

[11] Patent Number: 4,987,313

[45] **Date of Patent: * Jan. 22, 1991**

[54] METHOD OF AND APPARATUS FOR THE STORAGE OF RADIOACTIVE WASTE

[75] Inventors: Henning Baatz; Dieter Rittscher, both of Essen, Fed. Rep. of Germany

[73] Assignee: GNS Gesellschaft fur Nuklear-Service mbH, Essen, Fed. Rep. of Germany

[ * ] Notice: The portion of the term of this patent subsequent to Jan. 16, 2007 has been disclaimed.

[21] Appl. No.: 388,827

[22] Filed: Aug. 1, 1989

Related U.S. Application Data

[63] Continuation-in-part of Ser. No. 505,227, Jun. 17, 1983, Pat. No. 4,894,550.

[30] Foreign Application Priority Data

Jun. 18, 1982 [DE] Fed. Rep. of Germany ..... 3222764

[51] Int. Cl.[5] ..... G21F 5/00

[52] U.S. Cl. ..... 250/506.1; 252/632; 252/633; 159/47.3; 159/DIG. 12

[58] Field of Search ..... 250/506.1; 252/632, 252/633; 159/47.3, DIG. 12

[56] References Cited

U.S. PATENT DOCUMENTS

| | | | |
|---|---|---|---|
| 4,314,877 | 2/1982 | Queiser et al. | 159/47.3 |
| 4,675,129 | 6/1987 | Baatz et al. | 250/506.1 |
| 4,894,550 | 1/1990 | Baatz et al. | 250/506.1 |

*Primary Examiner*—Jack I. Berman
*Attorney, Agent, or Firm*—Herbert Dubno

[57] ABSTRACT

A method of and apparatus for the treatment and storage of nuclear power plant wastes utilizes a jacket heating a cast iron storage container directly to vaporize liquid radioactive waste under suction applied to the container with interposition of a baffle preventing entrainment of droplets from the container.

11 Claims, 3 Drawing Sheets

METHOD OF AND APPARATUS FOR THE STORAGE OF RADIOACTIVE WASTE

CROSS REFERENCE TO RELATED APPLICATIONS

This application is a continuation-in-part of Ser. No. 06/505,227 filed June 17, 1983 (now U.S. Pat. No. 4,894,550).

FIELD OF THE INVENTION

Our present invention relates to a method of storing radioactive waste and to an apparatus or plant for this purpose. More particularly, the invention relates to the improved shielding radioactive waste container described in the aforementioned copending application and apparatus associated therewith as well as a waste storage method utilizing that container.

BACKGROUND OF THE INVENTION

A lost concrete shielding container for the retention, storage and disposal of liquid radioactive wastes for a nuclear plant generating electric power is known. The container comprises a vessel having unitary walls and a floor. A lid sealingly closes an open mouth of the vessel and, like the walls and the floor, can be composed of concrete. The container can be filled with radioactive waste which can be mixed with cement or concrete can be poured into the partly filled container to seal the latter. A shield container of this type generally stores the radioactive waste without reduction of volume by vacuum or heating.

It is also known to transport and store spent fuel elements in cast iron or steel containers having a wall thickness of at least about 40 centimeters and sufficient, therefore, to provide a substantial shield effect. Generally these containers have heat exchange ribs and are closed by a casting of the same metal as forms the remainder of the container. Such containers have the advantage that they can be used to treat the waste, e.g. by heating them while exhausting vapors generated in them by the heat. In this manner wet but somewhat solid matter filtered from the cooling circuits of a nuclear-power plant can be dried out for permanent disposal in such containers.

OBJECTS OF THE INVENTION

It is the principal object of the present invention to provide an improved method of and apparatus for the disposal of liquid radioactive wastes which extend the principles of the above-mentioned application.

Another object of this invention is to provide a method of and apparatus for the disposal of radioactive waste which utilizes the container of the aforementioned application in a particularly effective and advantageous manner.

SUMMARY OF THE INVENTION

As has been alluded to above, an important component of the present invention is the shielded container of the above-mentioned copending application. That container can be used for the treatment of radioactive waste, according to the invention and is an upwardly cast-iron vessel having a closed bottom, solid walls unitary therewith and an upwardly open mouth which can be closed by a cast-iron lid which is formed with separate vertically throughgoing intake and outlet passages.

Screwthread formations either provided directly on the lid and vessel, or fasteners engaged between them hermetically secure the lid over the mouth. Advantageously, both the lid and the upper rim of the vessel are stepped and interfitted for this purpose.

An important element of the shielded container of the invention is a flow deflector aligned inside the vessel underneath the outlet passage and which is formed as a baffle plate so that aspirated gases do not entrain liquid or solid particles from the vessel. A single cover is held by appropriate screwthread formations on the cover over the passages.

The vessel of the invention can be relatively thin cast iron, e.g. of a thickness of 8 centimeters, 12 centimeters, or 18 centimeters, for example, so that it is possible to treat the contents of the vessel. The exterior of the vertical wall of the vessel may be free from rib formations and the like so that it can be closely surrounded by a heating mantel or jacket.

For drying radioactive wastes, it is merely necessary to heat the outside of the container while applying suction to the outlet passage.

The subatmospheric pressure thus created in the vessel allows the water to vaporize at well below 100° C., thereby drying the material with minimal energy and likelihood that potentially radioactive constituents will be evolved and entrained in a vapor state. The flow deflector is preferably a generally horizontal plate underlying and spaced below the outlet passage although the plate can be slightly frustoconical with an upward convergence. The plate is preferably supported by posts from the underside of the lid.

The system may also be provided with a tube connected to and extending downwardly in the vessel and forming a downward extension thereof. This is particularly useful when an ion exchange resin is to be introduced into the container in the form of lumps or particles. For maximum shielding the cast-iron vessel is provided with a lead lining. This makes the vessel capable of shielding as much radioactivity as far heavier all-iron vessels. In addition, the overall container weight is not excessive.

The method of the invention can comprise the steps of:

(a) providing an upwardly open cast-iron vessel having a closed bottom, a solid wall unitary therewith and an upwardly open mouth;

(b) closing the mouth by sealingly engaging a cast-iron lid thereof, the lid being formed with separate vertically throughgoing intake and outlet passages and providing in the vessel at least one flow deflector aligned beneath the outlet passage;

(c) surrounding the vessel with a heating jacket;

(d) introducing into the vessel through the intake passage a radioactive liquid;

(e) evacuating the vessel through the outlet passage and simultaneously heating the vessel with the jacket to evaporate liquid from the vessel and form vapors which are withdrawn past the deflector through the outlet passage; and (f) upon completion of filling of the vessel with a residue resulting from the evaporation of liquid from the contents of the vessel, hermetically engaging a cover over the passages.

The related apparatus can comprise:

a metering vessel receiving radioactive liquid material from a nuclear power plant;

at least one treating and storage container connectable to the vessel for receiving the material therefrom, the container being composed of cast iron and having a lid traversed by an inlet passage connectable to the vessel and an outlet passage, and a generally horizontal baffle disposed directly below the inlet passage;

a condenser connected to the outlet passage for condensing condensate received therefrom;

a suction pump connected to the condenser for evacuating the container through the condenser; and a heating jacket on the container for heating same simultaneously with evacuation of vapors therefrom.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
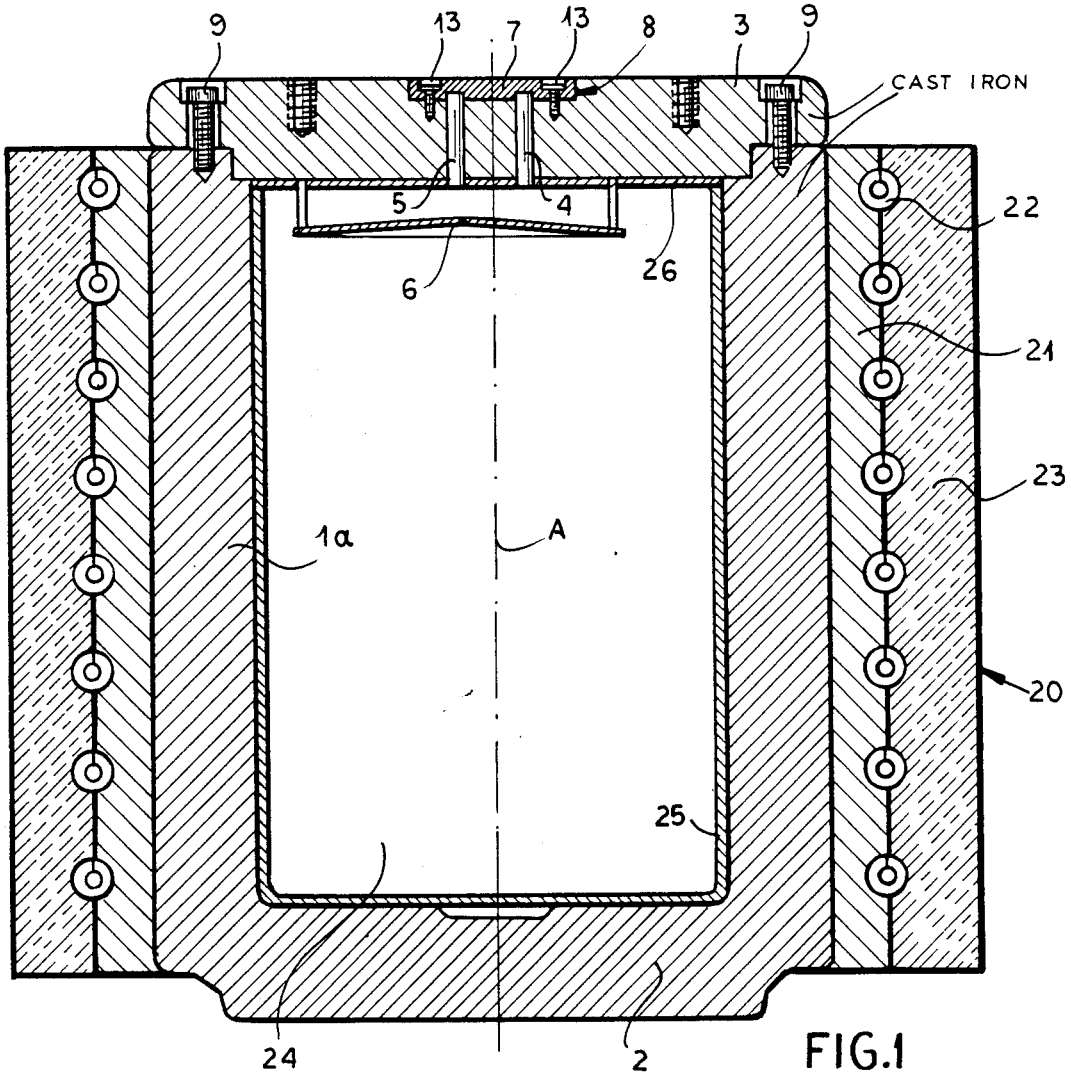
FIG. 1 is a diagrammatic section through a container according to the invention shown to be received in a heating jacket.
Figure 2:
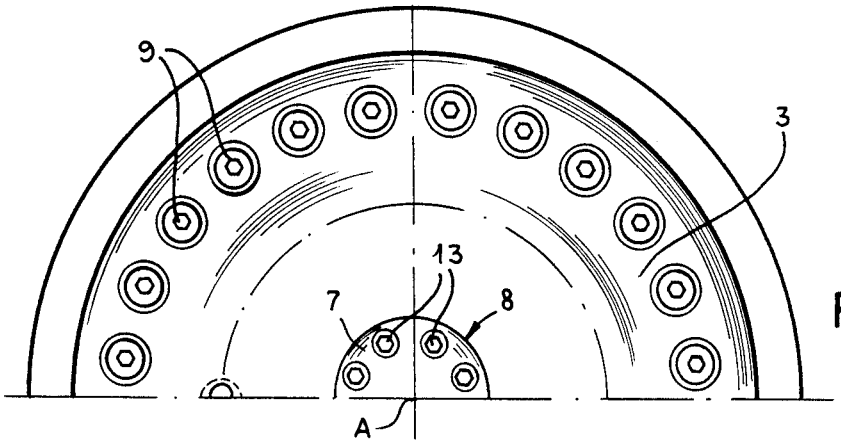
FIG. 2 is a top view of a portion of the container of FIG. 1.

As can be seen from FIGS. 1 and 2, a cast-iron treatment, storage and disposal vessel 1 is centered on an axis A and has a wall thickness of 8 centimeters, 12 centimeters or 18 centimeters and has a unitary closed bottom or floor 2. The upper edge or rim of the vessel 1 is stepped and is interfitted with a lid 3 also formed of cast iron and stepped to be complementary to the rim. The cylindrical outer surface of the vessel is not provided with cooling ribs but is smooth so that it can fit within an electric coil heater 20. The latter can be provided with a thermally conductive shell 21 snugly fitting around the wall 1*a* of the vessel 1 and in heat exchange relationship therewith, a resistance heating coil 22 received in the shell 21 and an outer lining 23 of thermally insulating material. The interior 24 of the vessel may be lined with lead as shown at 25 and a lead lining may likewise be provided at 26 on the underside of the lid 3.

Figure 4:
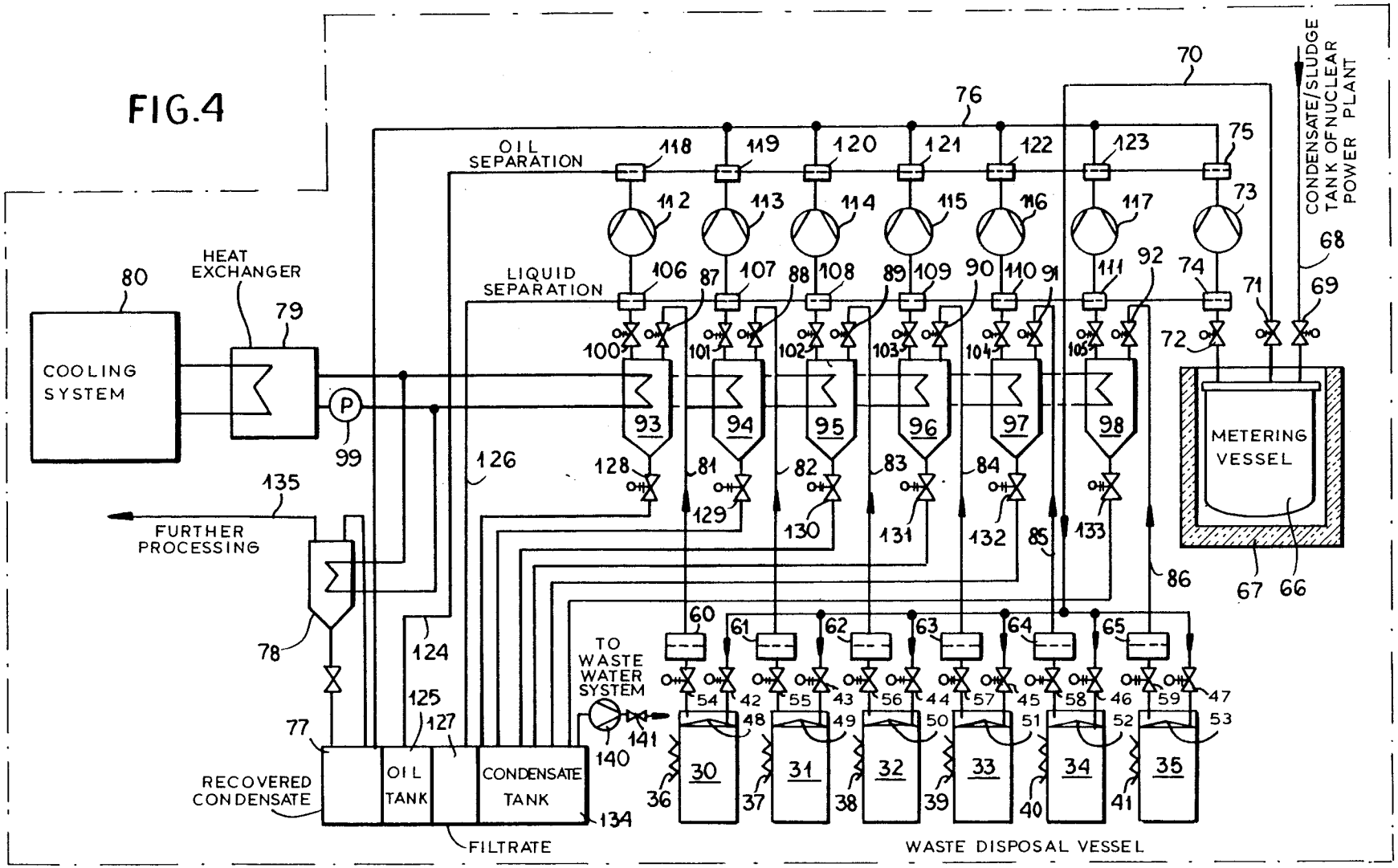
FIG. 4 is a flow diagram illustrating the filling of a container of the type shown in FIGS. 1 and 2.

The lid 3 is formed with a pair of throughgoing passages 4 and 5 which can be close together as shown in FIG. 1 but also may be spaced apart as shown, for example, in FIG. 4, the passages 4 and 5 being parallel to and offset from the axis A. The passage 4 serves for the introduction of liquids into the vessel and the passage 5 for the withdrawal of vapors and gases therefrom.

Although the lid 3 can be formed with it own screwthread to allow it to be turned or screwed down directly into the rim of the vessel 1, here it is secured in place by machine screws 9 angularly equispaced about and threaded into the vessel 1.

In a typical application, the condenser concentrate of a nuclear power plant can be held in this vessel while it is heated with the gases or vapors being withdrawn from the vessel. Low temperature and relatively clean steam is withdrawn at subatmospheric pressure while radioactive particulates are left inside.

In order to prevent droplets or particles from being aspirated, a downwardly flaring and generally conical relatively flat horizontal plate 6 interrupts direct vertical and axial flow into the passage 5.

Thus any rising gases will have to change direction and move horizontally to pass around the plate 6 and then change direction again to enter the passage 5.

Gases arising immediately beneath the plate 6 are forced into two more direction changes. In any case it is apparent that this arrangement effectively strips liquid and solid particles from the gas stream aspirated at the passage.

The upwardly tapering surface of the plate 6 allows droplets to run smoothly down and drip from its rim back into the liquid or dryng material within the vessel.

The upper surface of the lid 3 is formed at the upper ends of the passages 4 and 5 with a shallow cylindrical recess 8 into which is fitted a cylindrical cover 7 that is in turn fixed in place by screws 13 like the screws 9. However, this cylindrical cover can be provided on its rim with a thread which can be threaded directly into an internal thread of the recess 8. Thus the cover 7 has its upper surface flush with that of the lid 3 and seals off both of the passages 4 and 5 making the container safe and easier to handle.

Figure 3:
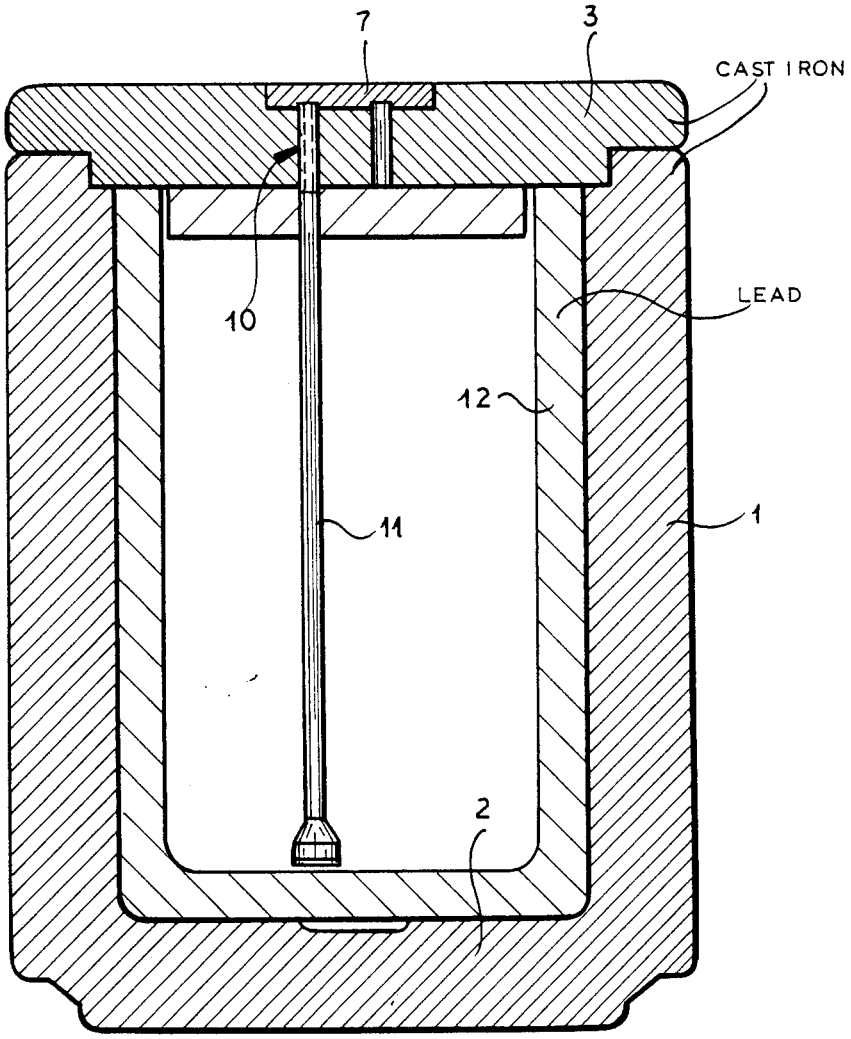
FIG. 3 is a section similar to that of FIG. 1 but showing another container.

It is also possible as seen in FIG. 3 to provide the lid 3 with a passage 10 which can supply material to the vessel and which may be formed with a tube or lance 11 (see U.S. Pat. No. 4,626,380, whose application Ser. No. 06/505,228 was copending with the above-identified parent application). This allows the container to be filled from the bottom up. A lead lining 12 is formed on this container. The vessel 1 is of sufficiently thin construction that its contents can be readily heated by the jackets.

In FIG. 4 we have shown an array of such vessels at 30, 31, 32, 33, 34 and 35, respectively provided with heating jackets 36, 37, 38, 39, 40 and 41 in the process of being filled. While one or more of the vessels may be in various stages of the supply of the liquid waste to the vessel, others may be in heating and evacuating stages. Since the filling of each vessel is done in stages, the various vessels shown may be at various stages in filling. The apparatus, however, will be described only with respect to the filling of one of these vessels.

Each of the vessels 30–35 has a valve 42–47 connected to its inlet passage 4 which, in the embodiment shown of the container in FIG. 4, can reach below the baffles 48–53 which have been diagrammatically shown therein.

Simultaneously, the outlets 5 located above the baffles 48–53 are provided with valves 54–59 which have ultra filters 60–65 downstream thereof. All of the valves described above and to be described below can be electrically actuated from a manually operated or automatically operated control panel, not shown.

The filling plant illustrated in FIG. 4 comprises a metering vessel 66 which is in a radiation shield 67 and which receives a quantity of condensate and sludge from the tank of a nuclear power plant via the line 68 and a valve 69. A pipe 70 provided with a valve 71 and reaching to the bottom of the vessel 66 serves to supply the liquid to be reduced in volume by evaporation to the storage vessels 30–35.

Vapor which may form above the liquid in the vessel 66 can be drawn off by a valve 72 and a vacuum pump 73 through a liquid separator or trap 74. Since the vacuum pump 73 operates with oil entrained in the fluid traversing same, an oil separator 75 is provided at the downstream side. The vapor may in part condense as a result of this compression and a line 76 which delivers this condensate to a recovered condensate tank 77. A reflux is provided by the condenser 78 which is cooled by a coolant flow from an intermediate heat exchanger 79, the latter being cooled, in turn, by a refrigeration plant 80.

Each of the vessels 30–35 thus can receive the incoming liquid from line 70.

Each of the vessels also has an outflow line 81–86 passing through a valve 87–92 to a condenser 93–98 cooled by the circulation from the intermediate heat exchanger 79 which may be provided with a pump 99 for this purpose.

Any residual vapors can pass via the valves 100–105 through the liquid separators 106–111 to the intake sides of the respective vacuum pumps 112–117. The outflow sides of these vacuum pumps are, in turn, provided with oil separators 1118–123.

The collected oil is delivered via line 124 to the oil tank 125 from which the oil can be reinjected into the vacuum pump.

The liquid recovered by the traps 74 and 106–111 can pass via line 126 to a filtrate tank 127.

The condensate from the condensers 93–98 passes via valves 128–133 to the condensate tank 134. The liquids in tanks 77, 125, 127 and 134 are radioactive and may be recycled for disposal or disposed of in some other way. The outflow from line 135 passes to an absolute filter system preventing the escape of radioactive vapors.

In practice, for each of the vessels 30–35, the respective inlet valve 47 (for example for the vessel 35) is opened after its outflow valve 59 has been closed and the vessel 35 has been evacuated so that, by suction, a quantity of liquid is drawn from the vessel 66 via line 70 into the vessel 35. Valve 47 is then closed, valve 59 is opened and the vessel 35 evacuated via the suction pump 117 while the vessel is heated to reduce the volume in the vessel.

The vapors which are thus produced are largely condensed in condenser 98 and flow via valve 133 to the condensate tank 134. Residual vapors are subjected to oil and liquid trapping as described. When suction has once again built up in the vessel 35 to the desired level, valve 59 is closed and valve 47 is opened to repeat the cycle. The process is repeated for each of the vessels 30–35 until each vessel is filled and the contents dried to the desired degree. The cover plate 7 is then applied as each vessel is disconnected from the apparatus and the container may be disposed of in a nuclear safe environment.

During the evacuation of each vessel 30–35, the baffle 48–53 largely prevents entrainment of droplets therefrom as has been described in connection with FIGS. 1 and 2.

If the condensate in tank 134, usually relatively pure water, is not significantly radioactive, it can be discharged directly via a pump 140 and a valve 141 into an industrial waste water treatment system.

We claim:

1. A method of storing radioactive waste, comprising the steps of:

(a) providing an upwardly open cast-iron vessel having a closed bottom, a solid wall unitary therewith and an upwardly open mouth;

(b) closing said mouth by sealing engaging a cast-iron lid thereof, said lid being formed with separate vertically throughgoing intake and outlet passages and providing in said vessel at least one flow deflector aligned beneath said outlet passage;

(c) surrounding said vessel with a heating jacket;

(d) introducing into said vessel through said intake passage a radioactive liquid;

(e) evacuating said vessel through said outlet passage and simultaneously heating said vessel with said jacket to evaporate liquid from said vessel and form vapors which are withdrawn past said deflector through said outlet passage; and (f) upon completion of filling of said vessel with a residue resulting from the evaporation of liquid from the contents of said vessel, hermetically engaging a cover over said passages.

2. The method defined in claim 1 wherein quantities of radioactive liquid are introduced into said vessel with intervening evacuation of vapors therefrom.

3. The method defined in claim 1 further comprising the step of condensing vapors withdrawn from said vessel.

4. An apparatus for the treatment of radioactive waste, comprising:

an upwardly open cast-iron vessel having a closed bottom, solid walls unitary with said bottom and an upwardly open mouth;

a cast-iron lid sealingly engaged over and completely blocking said mouth, said walls being smooth along their exteriors, said lid being formed with said vertically throughgoing intake and outlet passages;

means including screwthread formations for hermetically securing said lid over said mouth;

a flow deflector aligned inside said vessel beneath said outlet passage;

at least one cover sealingly engageable on said lid over said passages;

means including screwthread formations for hermetically engaging said cover over said passages; and a heating jacket surrounding said vessel and in heat transferring contact with said walls.

5. The apparatus defined in claim 4 wherein said vessel is formed with an internal lining of lead.

6. The apparatus as defined in claim 4 wherein said walls have a thickness less than about 20 centimeters.

7. An apparatus for treating and storing liquid radioactive waste, comprising:

a metering vessel receiving radioactive liquid material from a nuclear power plant;

at least one treating and storage container connectable to said vessel for receiving said material therefrom, said container being composed of cast iron and having a lid traversed by an inlet passage connectable to said vessel and an outlet passage, and a generally horizontal baffle disposed directly below said inlet passage;

a condenser connected to said outlet passage for condensing condensate received therefrom;

a suction pump connected to said condenser for evacuating said container through said condenser; and a heating jacket on said container for heating same simultaneously with evacuation of vapor therefrom.

8. The apparatus defined in claim 7 wherein a plurality of such containers are provided and all of said containers have respective inlet passages connected to said metering vessel, each of said containers having a respective outlet passage connected to a respective condenser and suction pump.

9. The apparatus defined in claim 8, further comprising an ultrafilter between each of said outlet passages and the respective condenser.

10. The apparatus defined in claim 8, further comprising a liquid separator between each condenser and the respective suction pump.

11. The apparatus defined in claim 8, further comprising a respective oil separator downstream of each suction pump.

* * * * *